United States Patent [19]

Agor et al.

[11] Patent Number: 4,981,276

[45] Date of Patent: Jan. 1, 1991

[54] SUPPORT FOR TOWELS AND THE LIKE

[76] Inventors: Alexander Agor, 108-28 Flatlands, 7 St., Brooklyn, N.Y. 11236; David Yaloz, 216-11 28 Ave., Bayside, N.Y. 11360

[21] Appl. No.: 392,562

[22] Filed: Aug. 11, 1989

[51] Int. Cl.[5] ..... F16B 7/00

[52] U.S. Cl. ..... 248/222.1; 248/251; 403/290

[58] Field of Search ..... 248/251, 224.3, 222.1, 248/224.4; 403/290

[56] References Cited

U.S. PATENT DOCUMENTS

| | | | |
|---|---|---|---|
| 1,096,282 | 5/1914 | Boehm | 248/251 |
| 1,891,048 | 12/1932 | Keefe | 248/222.1 |
| 1,893,729 | 1/1933 | Call | 248/251 |
| 1,934,911 | 11/1933 | Campbell | 248/222.1 |
| 1,970,473 | 8/1934 | Parker | 248/222.1 |
| 1,997,686 | 4/1935 | Hoegger | 248/222.1 |
| 2,451,884 | 10/1948 | Stelzer | 248/251 |
| 2,847,177 | 8/1958 | Ronan | 248/251 |
| 3,620,558 | 11/1971 | MacMillan | 403/290 |

*Primary Examiner*—Carl D. Friedman
*Assistant Examiner*—Daniel Hulseberg
*Attorney, Agent, or Firm*—Ilya Zborovsky

[57] ABSTRACT

A support for towels or the like has a first holder for holding a towel supporting rod, and a second holder mountable on a wall and connectable with the first holder by spreading inside the first holder.

2 Claims, 2 Drawing Sheets

SUPPORT FOR TOWELS AND THE LIKE

BACKGROUND OF THE INVENTION

The present invention relates to a support for towels and the like.

Supports of the above mentioned general type are known in the art. A known support includes a supporting rod and a structure which mounts the rod to a wall or holds it in a standing position. The existing mounting or holding structures are rather complicated in design and not simple to mount. It is believed to be clear that it would be desirable to simplify the design or the mounting or holding structures and facilitate their mounting on the respective walls.

SUMMARY OF THE INVENTION

Accordingly, it is an object of the present invention to provide a support for towels and the like which avoids the disadvantages of the prior art.

More particularly, it is an object of the present invention to provide the above mentioned support which has a simple design and is easy and simple to mount.

In keeping with these objects and with others which will become apparent hereinafter, one feature of the present invention resides, briefly stated, in a support for a towel or the like, which has a first holder for holding a supporting rod, and a second holder which is mountable on a wall and has a portion insertable in the first support and expandable in it to be firmly connected with the first support.

When the support is designed in accordance with the present invention, it has a simple design and is easy and simple to mount. It suffices just to mount the second holder on the wall by nails, fit the first holder on the second, and expand the latter by screwing a screw into the second holder.

The novel features of the present invention are set forth in particular in the appended claims. The invention itself however both as to its construction and manner of operation will be best understood from the following description of preferred embodiments which is accompanied by the following drawings.

DESCRIPTION OF THE PREFERRED EMBODIMENT

Figure 1:
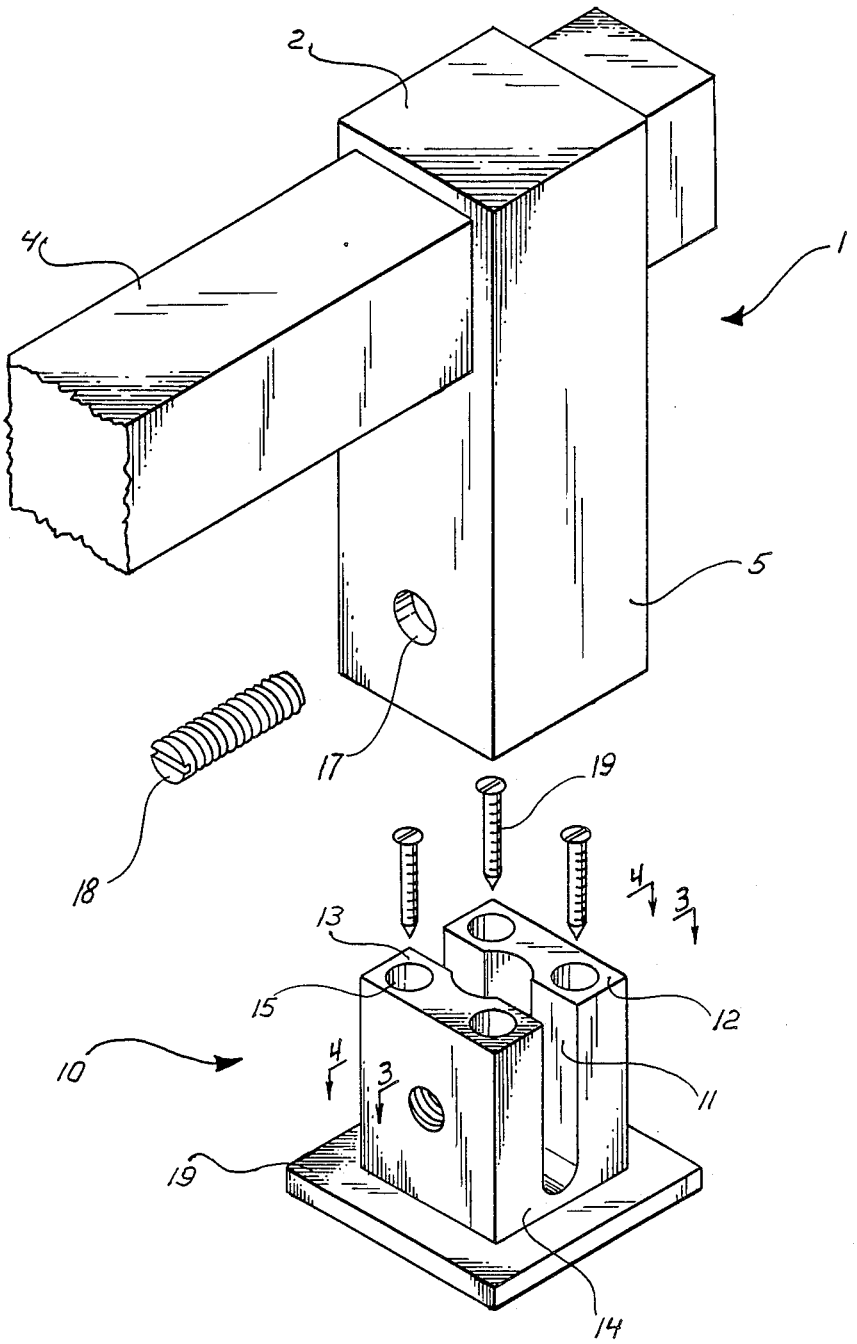
FIG. 1 is a perspective exploded view of a support for towel or the like in accordance with the present invention.
Figure 2:
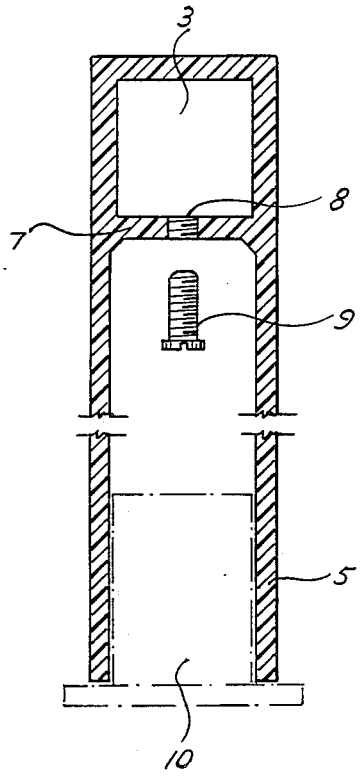
FIG. 2 is a section taken along the line 2—2 in FIG. 1.
Figure 3:
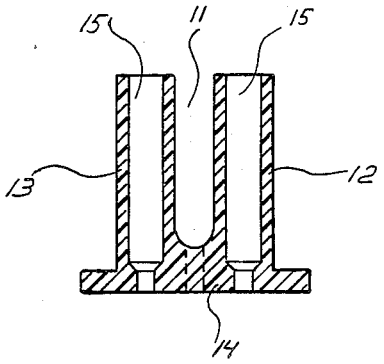
FIG. 3 is a section taken along the line 3—3 in FIG. 1.
Figure 4:
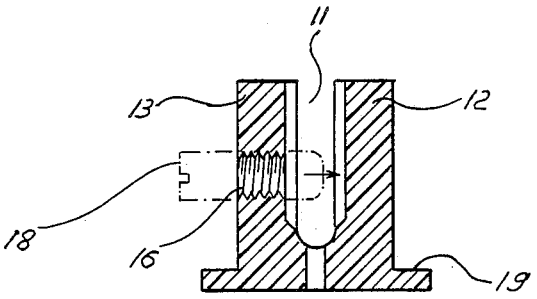
FIG. 4 is a view showing the section taken along the line 4—4 in FIG. 1.

A support for a towel or the like in accordance with the present invention is shown in FIG. 1. It includes a first holder which is identified as a whole with reference numeral 1. The holder 1 has a wall portion 2 which forms an opening 3. A supporting rod 4 extends through the opening 3 of the first holder 1. The first holder 1 has another wall portion 5 which extends transversely to the portion 2. The other portion 5 forms an inner hollow 6 which extends transversely to the opening 3. The support is further provided with means for tightening the supporting rod 4 in the first holder 1 in a desired position. The position of the supporting rod can be adjusted in the longitudinal direction, so that at the opposite sides of the first holder, rod portions of required length extend. When the position of the supporting rod relative to the first holder is adjusted, the supporting rod is tightened in the first holder. For this purpose a partition 7 between the first portion and the second portion of the first holder 1 is provided with a threaded hole 8. A screw 9 is screwed in the inner hollow 6 of the first holder 1 through the threaded hole 8, so that the front end of the screw 9 abuts against a surface of the supporting rod 4, and the latter is fixed in its selected position.

The support further has a second holder which is identified as a whole with reference numeral 10. The holder 10 has an inner hollow 11 which is formed as a transverse slot subdividing the second holder into two parts 12 and 13. At their bottom ends the parts 12 and 13 are connected with one another by a bridge 14 so that the parts 12 and 13 can move toward and away of one another. Each of the parts 12 and 13 has at least one but preferably two throughgoing openings 15 extending along the part and opening at its both opposite faces. Finally, a transverse opening 16 extends through the part 13 from its outer end face to its inner end face. The opening 16 is provided with inner thread. The wall portion 5 of the first holder is provided with an opening 17. The holder is of metal or plastic. The holder 10 is provided with a flange 19 for abutting the lower edge of the holder 1.

The mounting of the support is performed as follows:

First the holder 10 is attached to the wall by driving the nails 20 through its holes 15 and into the wall. Then the holder 1 is fitted onto the holder 10 by fitting its portion 5 over the holder 10. After this, a screw 18 is screwed through the opening 17 into the threaded opening 16 so that its end abuts against an inner face 19 of the part 12. During further screwing in of the screw 18, the parts 12 and 13 are spread apart and firmly abut with their outer faces against inner faces of the portion 5. As a result, the portion 5 becomes fixed on the holder 10. The rod 10 is inserted into the opening 3 of the holder 1 and fixed in the desired position with the screw 9 prior to the fitting of the holder 1 on the holder 10.

The novel features of the present invention are set in the claims. Various modifications and structural changes are possible without departing in any way from the spirit of the present invention.

What is desired to be protected by Letters Patent is set forth in the claims.

1. A support for towels or the like, comprising a supporting rod arranged to support a towel or the like;

a first holder having a receiving opening formed so that said supporting rod extends through said opening, said first holder being hollow;

a means for tightening said supporting rod in said receiving opening of said first holder;

a second holder mountable on a wall and connectable with said first holder, said second holder formed as a single piece and having at least a portion insertable into said first holder;

means for connecting said second holder with said first holder and including at least on longitudinal slot subdividing said portion of said second holder into two integrally connected partially parts movable away of one another so as to expand said second holder for making said portion of said second holder expandable, and means for expanding said portion of said second holder inside said first holder so as to firmly clamp the former in the latter, said expanding means including a screw, wherein one of said two parts having a threaded opening through which said screw is screwed so as to abut against the other of said two parts and thereby to push said two parts away from one another so as to expand said portion of said second holder inside said first holder, said second holder having a plurality of throughgoing openings extending through said two parts of said portion of said second holder for passing therethrough means for mounting said second holder on the wall and extending perpendicular to said threaded opening, said second holder having a flange with a cross section which is greater than a cross section of said portion of said second holder, and first holder having an end abutting against said flange, 2. A support for towels or the like, comprising a supporting rod arranged to support a towel or the like;

a first holder having a receiving opening formed so that said supporting rod extends through said opening, said first holder being hollow;

a second holder mountable on a wall and connectable with said first holder, said second holder formed as a single piece having at least a portion insertable into said first holder;

means for connecting said second holder with said first holder and including at least one longitudinal slot subdividing said portion of said second holder into two integrally connected parts movable away from one another so as to expand said second holder for making said portion of said second holder expandable and means for expanding said portion of said second holder inside said first holder so as to firmly clamp the former in the latter;

means for tightening said supporting rod in said receiving opening of said first holder and including a partition limiting said opening at one side and a screw extending through said partition and abutting against said supporting rods; and said first holder having a hollow separated by said partition from said opening and formed so that said first holder is fitted on said second holder by inserting said portion of said first holder into said hollow, and also so that said screw for tightening said supporting rod is inserted through said hollow to extend through said partition and to tighten said supporting rod.

* * * * *